US007874020B1

(12) United States Patent
Franklin

(10) Patent No.: US 7,874,020 B1
(45) Date of Patent: Jan. 25, 2011

(54) GLOVES HAVING SNAP-ON CLEANING PADS

(76) Inventor: Antoine Franklin, P.O. Box 34, Hayward, CA (US) 94543

( * ) Notice: Subject to any disclaimer, the term of this patent is extended or adjusted under 35 U.S.C. 154(b) by 151 days.

(21) Appl. No.: 12/429,212

(22) Filed: Apr. 24, 2009

(51) Int. Cl.
*A47L 13/18* (2006.01)
*A41D 19/00* (2006.01)

(52) U.S. Cl. ..... 2/160; 2/161.1; 2/162; 2/170; 2/161.4; 2/161.7; 15/229.11; 15/229.12

(58) Field of Classification Search ..... None
See application file for complete search history.

(56) References Cited

U.S. PATENT DOCUMENTS 4,038,787 A * 8/1977 Bianchi ..... 451/523
4,107,840 A * 8/1978 Kupperman et al. ..... 30/172
5,003,637 A * 4/1991 Lonon ..... 2/160
D349,373 S * 8/1994 Marley ..... D32/43
5,956,770 A * 9/1999 Dennis ..... 2/160
6,018,837 A * 2/2000 Andreu ..... 15/118
6,098,234 A * 8/2000 Jackson, Jr. ..... 15/118
6,280,529 B1 * 8/2001 Meyer ..... 134/6
6,398,443 B1 * 6/2002 Barela ..... 401/201
D459,859 S * 7/2002 Poteat ..... D2/617
6,557,178 B1 * 5/2003 Hoover ..... 2/161.6
6,604,244 B1 * 8/2003 Leach ..... 2/161.6
7,484,261 B2 * 2/2009 Sigl et al. ..... 15/104.94
7,636,978 B2 * 12/2009 Blokpoel ..... 15/104.94
2005/0229284 A1 * 10/2005 Gaetz ..... 2/159
2006/0230559 A1 * 10/2006 Knopow et al. ..... 15/104.002
2006/0272116 A1 * 12/2006 Thompson ..... 15/227
2008/0301852 A1 * 12/2008 Suran et al. ..... 2/161.8

* cited by examiner

*Primary Examiner*—Bobby H Muromoto, Jr.
(74) *Attorney, Agent, or Firm*—Kyle Fletcher

(57) ABSTRACT

The gloves having snap-on cleaning pads include a front cleaning pad and a rear cleaning pad. Both the front and the rear cleaning pad are capable of contouring the knuckle regions of the hand, and attach to the glove via a plurality of snap buttons and/or nylon hook and loop fasteners. The front and rear cleaning pads are disposable and are made of a scouring material such as metal wool. The gloves themselves are made of a waterproof material such as rubber or latex.

16 Claims, 3 Drawing Sheets

GLOVES HAVING SNAP-ON CLEANING PADS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of gloves, more specifically, cleaning glove that has a plurality of snap-on cleaning pads.

B. Discussion of the Prior Art

As a preliminary note, it should be stated that there is an ample amount of prior art that deals with gloves. As will be discussed immediately below, no prior art discloses a cleaning glove that has snap-on disposable pads for use with cleaning.

The Jackson, Jr. patent (U.S. Pat. No. 6,098,234) discloses a cleaning system comprising a glove, a wash cloth assembly, a buffer cloth assembly, and six hook and pile scrubber fastening sections for attaching the wash and buffer cloths. However, Elle glove does not have a flexible scrubber pad that attaches along the back side of the hand as well as the palm side of the hand.

The Knopow et al. Patent Application Publication (U.S. Pub. No. 2006/0230559) discloses a fabric cleaning mitt comprising a plurality of removable cleaning sheets, a carrier configured to mate with attachment pads via hook and loop or snap fastening mechanisms, wherein the pads can be flipped over and kept on the backside of the mitt and made of nylon, rubber, or thermoplastic elastomers. However, the mitt is not a glove that has a removable, scrubbing or cleaning pad for the backside as well as the palm side of the hand.

The Meyer patent (U.S. Pat. No. 6,280,529) discloses adherent wipes affixed to gloves comprising gauze, sponge, or abrasive pads, the pads have a band that are attached to a glove by hook and loop or snap fasteners, and wherein the pad is attached to the back of the glove. However, the pad does not have the ability to flex to and contour the knuckle region of the glove, nor does it include a scrubber along the front of the glove or palm region.

The Dennis patent (U.S. Pat. No. 5,956,770) discloses a glove with attachable cleaning pads comprising a plurality of cleaning pads shaped in the form of a hand, each of which have a different cleaning purpose, a plurality of hook and loop patches that can be substituted with alternate forms of securement means. However, the glove does not have a cleaning pad that attaches to the rear of the hand and of which is capable of flexing in order to contour the knuckle region.

The Hoover patent (U.S. Pat. No. 6,557,178) discloses a versatile sanding glove comprising hook fastener material for attaching to loop backed sanding pads. However, the glove does not have sanding pads on the rear side of the glove, and is also directed to the use of sanding as opposed to a cleaning glove. While the above-described devices fulfill their respective and particular objects and requirements, they do not describe gloves having snap-on cleaning pads having a front cleaning pad and rear cleaning pad that attach via snap fasteners and/or nylon hook and loop strips and of which said cleaning pads are capable of flexing about the knuckle regions of the hand. In this regard, the gloves having snap-on cleaning pads departs from the conventional concepts and designs of the prior art.

SUMMARY OF THE INVENTION

The gloves having snap-on cleaning pads include a front cleaning pad and a rear cleaning pad. Both the front and the rear cleaning pad are capable of contouring the knuckle regions of the hand, and attach to the glove via a plurality of snap buttons and/or nylon hook and loop fasteners. The front and rear cleaning pads are disposable and are made of a scouring material such as metal wool. The gloves themselves are made of a waterproof material such as rubber or latex.

An object of the invention is to provide a set of cleaning gloves that have removable cleaning pads adorning the front and rear sides of the glove.

A further object of the invention is to provide a set of cleaning gloves that have disposable cleaning pads with flexibility along the regions adjacent the knuckles of the hand, while also containing rigidity elsewhere along the cleaning pads.

These together with additional objects, features and advantages of the gloves having snap-on cleaning pads will be readily apparent to those of ordinary skill in the art upon reading the following detailed description of presently preferred, but nonetheless illustrative, embodiments of the gloves having snap-on cleaning pads when taken in conjunction with the accompanying drawings.

In this respect, before explaining the current embodiments of the gloves having snap-on cleaning pads in detail, it is to be understood that the gloves having snap-on cleaning pads is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the gloves having snap-on cleaning pads. It is therefore important that the claims be regarded as including such equivalent construction insofar as they do not depart from the spirit and scope of the gloves having snap-on cleaning pads. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
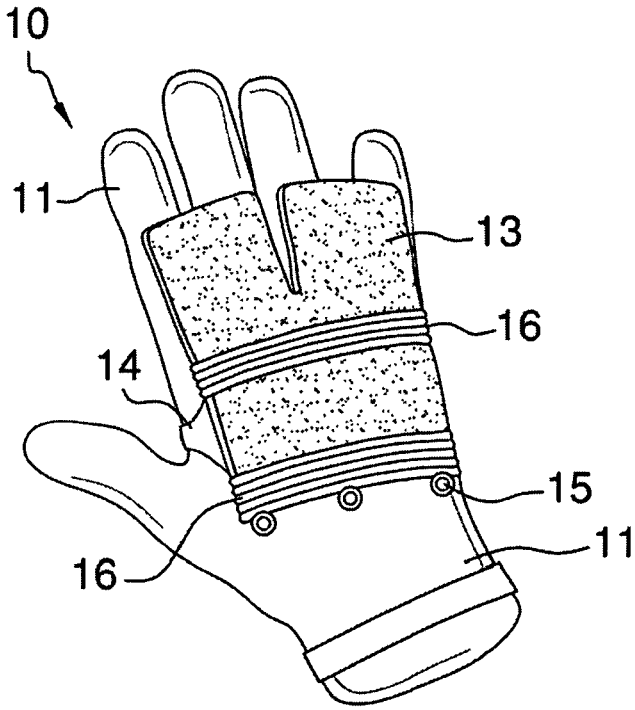
FIG. 1 illustrates a rear view of the glove and the rear cleaning pad.
Figure 2:
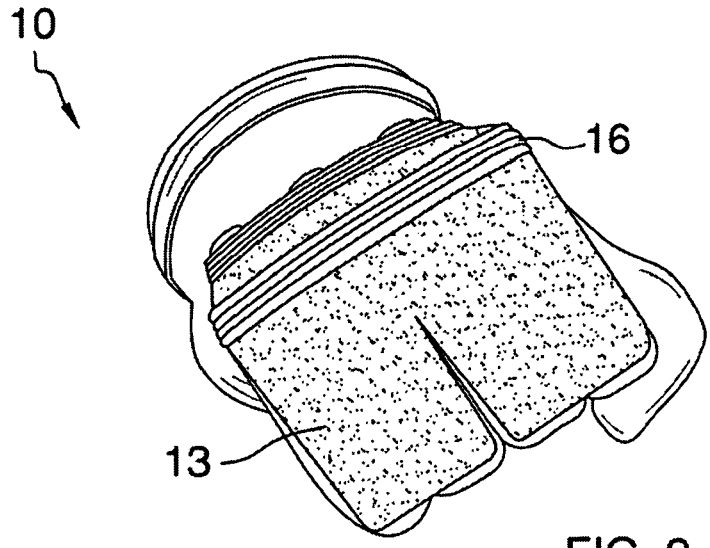
FIG. 2 illustrates a front, rear view of the glove and rear cleaning pad with the hand forming a first in order to depict the flexibility of the rear cleaning pad.
Figure 3:
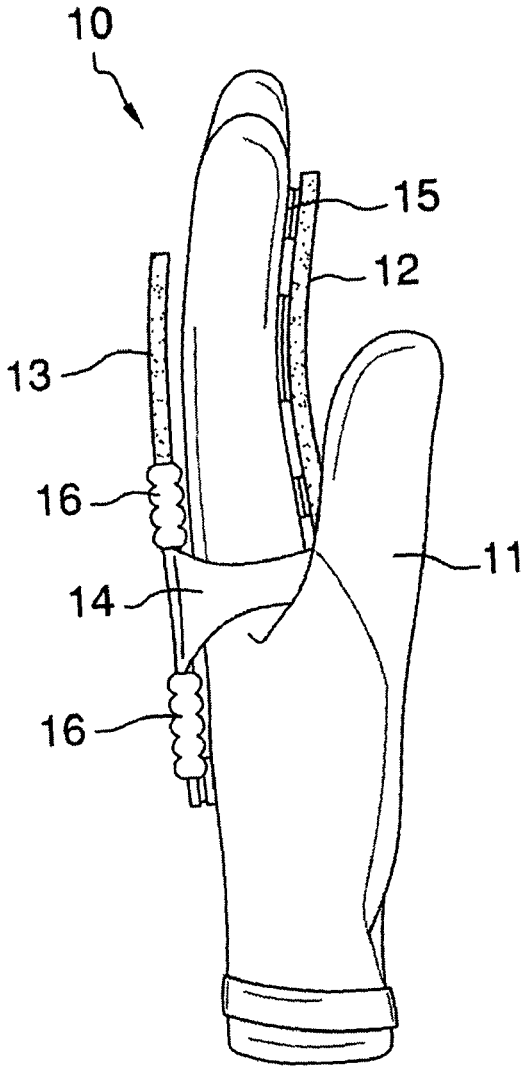
FIG. 3 illustrates a side view of the glove with the front and rear cleaning pads attached and also detailing the cross-brace that connects the front cleaning pad to the rear cleaning pad.
Figure 4:
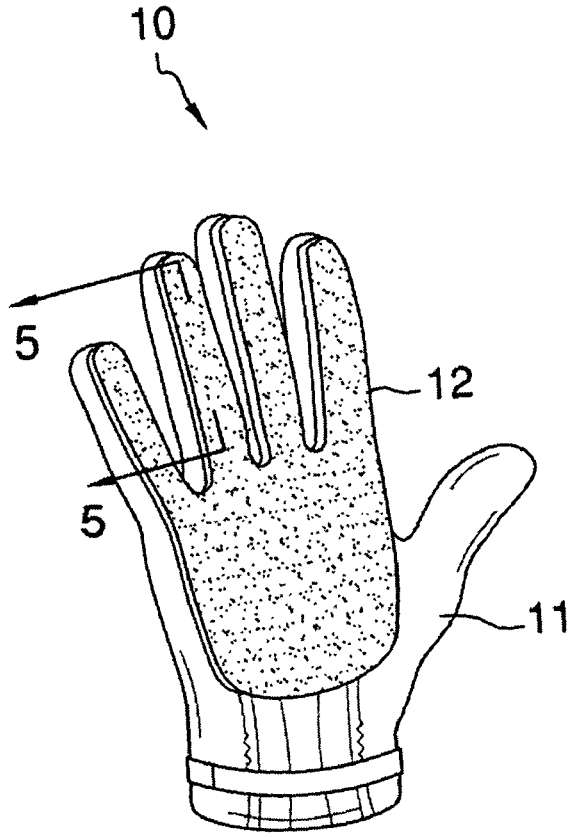
FIG. 4 illustrates an isometric view of the front cleaning pad and the palm of the glove.
Figure 5:
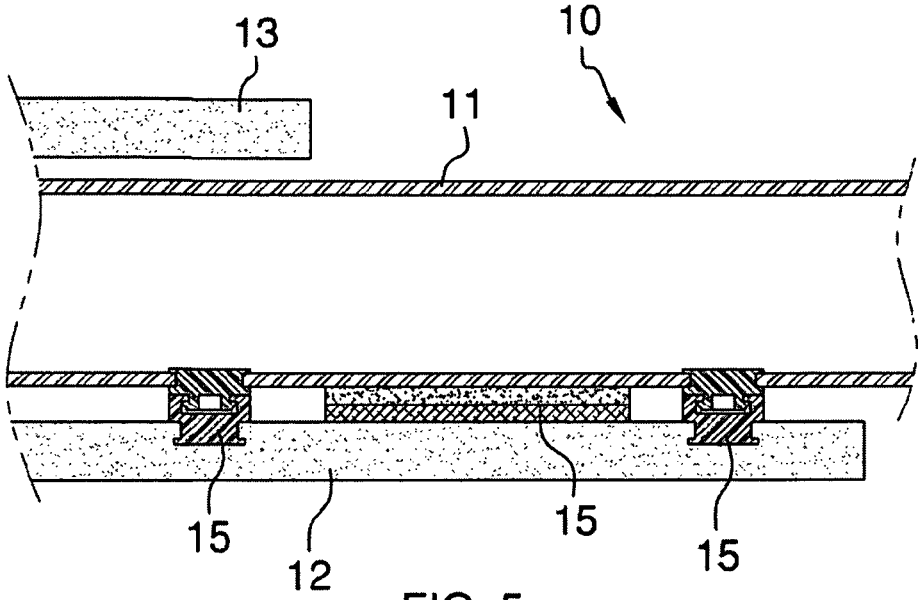
FIG. 5 illustrates a cross-sectional view of the glove along line 5-5 in FIG. 4.

Detailed reference will now be made to the preferred embodiment of the present invention, examples of which are illustrated in FIGS. 1-6. A pair of gloves having snap-on cleaning pads 10 (hereinafter invention) includes a glove 11, a front cleaning pad 12, and a rear cleaning pad 13.

The front cleaning pad 12 connects to the rear cleaning pad 13 via a cross-brace 14 that crosses the ridge between the thumb and index finger. However, it shall be noted that the cross-brace 14 may be disconnected from either or both the front cleaning pad 12 and the rear cleaning pad 13 in order to replace either or both the front cleaning pad 12 and the rear cleaning pad 13, especially if the rate of wear on said pads is different.

Both the front cleaning pad 12 and rear cleaning pad 13 attach to the surface of the glove 11 via an attaching means 15 comprising a plurality of snap buttons and/or nylon hook and loop material.

Both the front cleaning pad 12 and the rear cleaning pad 13 have flexible regions 16 that enable the respective cleaning pad to flex at regions adjacent the knuckles of the glove 11.

Both the front cleaning pad 12 and the rear cleaning pad 13 are made of a material comprising a steel wool. The glove may be made of a material comprising a rubber or latex.

Figure 6:
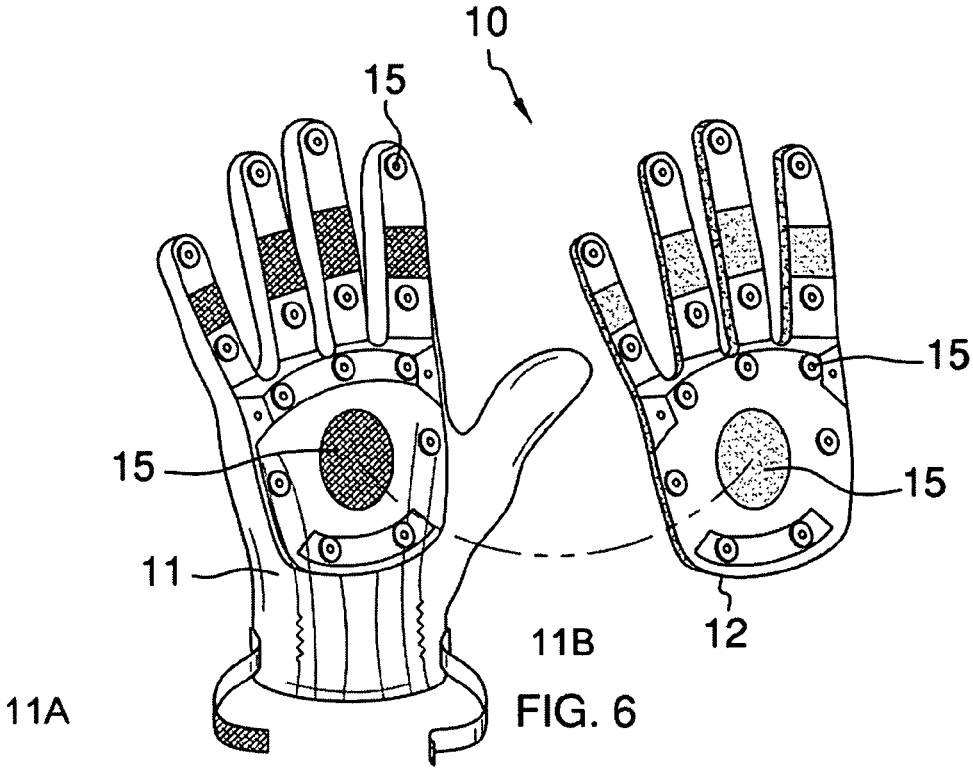
FIG. 6 illustrates the palm of the glove detached from the front cleaning pad and a line indicating alignment of the nylon hook and loop strips as well as an adjustably elastic strap about the base of the glove.

Referring to FIG. 6, the glove 11 has an adjustable strap 11A about the base of the glove 11. The glove 11 also has a region of elastic material 11B that is flexible when the invention 10 is used, more specifically, the palm side of the glove 11.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A cleaning glove comprising:

(a) a front cleaning pad;

wherein the front cleaning pad attaches to the palm side of the glove and resembles a hand absent the thumb;

(b) a rear cleaning pad;

wherein the rear cleaning pad attaches to the back side of the glove and has a generally square shape;

wherein the front and the rear cleaning pad connect to the surface of the glove via a fastening means;

wherein the front and the rear cleaning pad connect to each other via a cross-brace that passes across the ridge of glove between the thumb and index finger; and wherein the front and the rear cleaning pad have flexibility adjacent the knuckle area of the glove.

2. The cleaning glove as described in claim 1 wherein the fastening means comprises a plurality of snap buttons or nylon hook and loop fasteners.

3. The cleaning glove as described in claim 1 wherein the glove is made of a material comprising a rubber or latex.

4. The cleaning glove as described in claim 1 wherein the front cleaning pad and rear cleaning pad are disposable.

5. The cleaning glove as described in claim 1 wherein the front cleaning pad and rear cleaning pad are made of a material such as steel wool.

6. The cleaning glove as described in claim 1 wherein the cross-brace can be disconnected from either the front cleaning pad or the rear cleaning pad in order for replacement of a cleaning pad that has worn more quickly than the opposing cleaning pad.

7. The cleaning glove as described in claim 1 wherein a flexible strap adorns an area adjacent a wrist area of said glove.

8. The cleaning glove as described in claim 1 wherein a region of a palm area of said glove is made of an elastic material that stretches when the front cleaning pad is in use.

9. A cleaning and scouring glove further comprising:

a front cleaning pad that attaches to the palm side of said glove and covers the front of a hand less the thumb;

a rear cleaning pad that attaches to the back side of said glove, and wherein the rear cleaning pad connects to the front cleaning pad via a cross-brace that traverses across the region between a thumb and index finger;

wherein the front and the rear cleaning pad connect to the surface of said glove via a fastening means.

10. The cleaning and scouring glove as described in claim 9 wherein the fastening means comprises a plurality of snap buttons or nylon hook and loop fasteners.

11. The cleaning and scouring glove as described in claim 9 wherein the glove is made of a material comprising a rubber or latex.

12. The cleaning and scouring glove as described in claim 9 wherein the front cleaning pad and rear cleaning pad are disposable.

13. The cleaning and scouring glove as described in claim 9 wherein the front cleaning pad and rear cleaning pad are made of a material such as steel wool.

14. The cleaning and scouring glove as described in claim 9 wherein the cross-brace can be disconnected from either the front cleaning pad or the rear cleaning pad in order for replacement of a cleaning pad that has worn more quickly than the other cleaning pad.

15. The cleaning and scouring glove as described in claim 9 wherein a flexible strap adorns an area adjacent a wrist area of said glove.

16. The cleaning and scouring glove as described in claim 9 wherein a region of a palm area of said glove is made of an elastic material that stretches when the front cleaning pad is in use.

* * * * *